US008015683B2

(12) United States Patent
Hume

(10) Patent No.: US 8,015,683 B2
(45) Date of Patent: Sep. 13, 2011

(54) PULLEY REMOVAL SYSTEM, METHOD, KITS AND COMPONENTS THEREOF

(75) Inventor: Timothy Hume, Orange, CA (US)

(73) Assignee: Schlem Products, Inc., Anaheim, CA (US)

( * ) Notice: Subject to any disclaimer, the term of this patent is extended or adjusted under 35 U.S.C. 154(b) by 1306 days.

(21) Appl. No.: 11/598,256

(22) Filed: Nov. 9, 2006

(65) Prior Publication Data

US 2008/0110007 A1 May 15, 2008

(51) Int. Cl.
*B23P 19/04* (2006.01)
*B25B 27/02* (2006.01)

(52) U.S. Cl. ..... 29/255; 29/244; 29/259; 29/426.5

(58) Field of Classification Search ..... 29/255, 29/244–254, 256–267, 270–278
See application file for complete search history.

(56) References Cited

U.S. PATENT DOCUMENTS 5,159,743 A * 11/1992 Somerville ..... 29/252
5,174,005 A * 12/1992 Somerville ..... 29/261
D358,081 S * 5/1995 Tallon ..... D8/19
5,557,833 A * 9/1996 Pool ..... 29/261
6,266,859 B1 * 7/2001 Hernandez ..... 29/256
6,609,283 B1 * 8/2003 Somerville ..... 29/262
6,895,646 B1 * 5/2005 Houg ..... 29/252
D561,544 S * 2/2008 Hume ..... D8/14
7,669,306 B2 * 3/2010 Palka ..... 29/261
2008/0110007 A1 * 5/2008 Hume ..... 29/244

* cited by examiner

*Primary Examiner* — Lee D Wilson
(74) *Attorney, Agent, or Firm* — John J. Connors; Connors & Assoc. PC

(57) ABSTRACT

A pulley removal system used to remove a pulley attached to an internal combustion engine includes a plurality of puller jaw members adapted to be detachably and radially connected to a hub member. Each jaw member comprises an elongated body having a top surface, an underside surface, and first and second opposed ends. The first end is adapted to be attached to the hub member, and the second end has hooked tip free to grasp a flange of a pulley. The hooked tip has a terminal edge with predetermined dimensions that enable it to fit within different sized recesses in the flange of the different pulleys and an underside arcuate surface extending from the terminal edge and merging with the underside surface to form a bite that receives the flange when the terminal end fits within the recess in the flange. The thickness of the elongated body gradually decreases between the first and second opposed ends so the underside surface inclines towards the hooked tip and the thickness of the body is greater near the first end than near the second end.

1 Claim, 8 Drawing Sheets

13°
17°
TE
E1
E2
40
41
42a
42b
42c
42d
60a
60b
70a
70b
12
12a
12b
12c
14
14a
14b
16
17
19
19a
10
X
H7
SS
B
Q
d3
W
W1
t1
t2
R1
R2
R3

PULLEY REMOVAL SYSTEM, METHOD, KITS AND COMPONENTS THEREOF

INCORPORATION BY REFERENCE

The inventor incorporates herein by reference any and all U.S. patents, U.S. patent applications, and other documents, hard copy or electronic, cited or referred to in this application, and U.S. Provisional Patent Application No. 60/681,982.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

"Rectangular" includes square.

"Trapezoidal" shall mean shaped somewhat like a trapezoid.

BACKGROUND OF THE INVENTION

Periodic service of automobiles sometimes requires the removal of a harmonic damper pulley used on many automotive engines, including Chrysler and GM (General Motors) engines. The harmonic damper pulley is attached to the end of the engine's crankshaft, which projects from the front of the engine block into a confined space surrounded by a radiator, suspension components, fuel lines, fan shrouds, drive belts, etc. A pulley puller tool used to disconnect the pulley from the crankshaft must be able to access the pulley within the confined space available. A suitable tool includes three puller jaws, a hub providing three radial, puller jaw attachment locations on the hub's perimeter, a plurality of push rods of different lengths, and a forcing screw used to advance a selected push rod against the end of the engine's crankshaft while the jaws grip a flange of the pulley. The push rod is selected based on the type of engine being serviced. This selected rod is inserted longitudinally through a threaded access hole in the hub and positioned between the end of the engine's crankshaft and a tip of the forcing screw. The forcing screw is screwed into the access hole and rotate to advance the rod and force the jaws to pull the pulley from the crankshaft.

A precise puller jaw length, jaw tip thickness, jaw hooking angle, jaw taper are required for the jaw to access, attach and pull the pulley from the crankshaft without removal of the adjacent radiator, suspension components, fuel lines, fan shrouds, drive belts, etc. The conventional pulley puller tool is deficient mainly because the tool's jaws will only grip the flanges of a limited number of pulleys. These conventional tools have jaw tips that are to thick with the wrong jaw tip taper and wrong jaw tip angle to access many harmonic damper pulleys being serviced. These jaws do not allow reaching behind the pulley flange due to jaw tip depth, or they do not fit the harmonic damper pulley flange due to jaw tip width, or they do not stay attached to the pulley flange due to jaw tip angle. Moreover, the number of push rods available in the standard kits containing the conventional pulley puller tool is inadequate and additional longer rods are required to accommodate the numerous types of harmonic damper pulleys being serviced. Specifically, one such conventional tool sold by the Schley Products Company, Inc. under the product number 97400 is able to service many older Chrysler and GM engines models but unable to service Chrysler 5.7 liter V-8 Hemi 2004 and later, the GM 2.8 liter straight four cylinder engine, GM 3.5 liter straight five cylinder engine, the GM 4.2 liter straight six cylinder engine, GM 3.5 liter V six cylinder engine 2004 and later, and GM 3.9 liter V six cylinder engine 2006 and later (herein referred to as recent engine models). It would be highly desirable to provide a pulley puller tool capable of serving both the older and recent engine models.

SUMMARY OF INVENTION

The pulley removal system of this invention is used to remove a pulley attached to an end of a crankshaft extending through an engine block, with the pulley including a flange nearby the block to provide a restricted space between the engine block and the flange that is accessed during removal of the pulley by uniquely configured jaw members of this invention. This invention has one or more features as discussed subsequently herein. After reading the following section entitled "DETAILED DESCRIPTION OF ONE EMBODIMENT OF THIS INVENTION," one will understand how the features of this invention provide its benefits. The benefits of this invention include, but are not limited to: providing a pulley removal system, methods, and kits and components thereof that may be used with numerous different types of pulleys, thereby increasing its usefulness, and providing a kit with at least three uniquely configured jaw members of the pulley removal system of this invention and one long push rod of a length hitherto not used in a standard pulley puller tool.

Without limiting the scope of this invention as expressed by the claims that follow, some, but not necessarily all, of its features are:

One, the system of this invention includes a hub member and a plurality of puller jaw members adapted to be detachably and radially connected to the hub member, with each jaw member being essentially identical. It may also include a plurality of push rods, each rod having a length differing from the other rods and each rod adapted to interact with an engine's crankshaft end on which the pulley is mounted when the pulley is being removed. It may also include a screw member that is adapted to be threaded into a threaded center opening in the hub member. The screw member may have a tip with a cavity therein extending lengthwise that is adapted to receive a portion of an individual rod during removal of the pulley.

Two, each jaw member may comprise an elongated body having a longitudinal reference line. The body may have a substantially flat top surface and a substantially flat underside surface. The elongated body may have first and second opposed ends, the first end being adapted to be attached to the hub member and the second end, including a hooked tip, being free to grasp a flange of a pulley mounted to a crankshaft. The first end may include an opening therein that is substantially at a right angle to the reference line and the body may have opposed substantially flat side surfaces substantially at a right angle to the top and underside surfaces. The elongated body may have a predetermined length substantially from 2.250 to 3.250 inches, a predetermined width substantially from 0.250 to 0.750 inches that is substantially constant along the length of the body, and a predetermined thickness substantially from 0.400 to 1.000 inches that is greater near the first end than near the second end.

Three, the body may have a thickness that gradually decreases linearly and uniformly from near the first end to near the second end so the flat underside surface inclines towards the hooked tip. The hooked tip may have inner and outer opposed arcuate surfaces that diverge outwardly from a narrow terminal edge. This terminal edge may have a maximum thickness of 0.250 inch. The outer arcuate surface may have a radius of curvature greater than the radius of curvature of the inner arcuate surface, and the outer arcuate surface may be compound, being formed by two curves that merge. The hooked tip may have opposed sides that taper inwardly towards the terminal edge. The terminal edge may be substantially straight and substantially at a right angle to the reference line and it may have a maximum width dimension that enables it to fit within a recess in a flange of the pulley.

Four, the outer arcuate surface may merge with the top surface near the second end and the inner arcuate surface may merge with the underside surface near the second end. A bite may be formed where the underside surface merges with the inner arcuate surface to configure the hooked tip to enable it to fit within the restricted space. At least a portion of the bite may be offset inwardly of the terminal edge.

These features are not listed in any rank order nor is this list intended to be exhaustive.

This invention also includes a method of removing a pulley from the end of a crankshaft extending through an engine block, with pulley including a flange nearby the block to provide a restricted space between the engine block and the flange that is accessed during removal of the pulley. The method comprises the steps of (a) grasping the flange of the pulley with a plurality of jaw members of a pulley removal tool connected to a hub member of the tool, each said jaw member including a hooked tip at an end of a body member including a inclined underside that merges with a bite in the hooked tip, said hooked tip including a narrow terminal edge that in conjunction with the bite is configured to fit within the restricted space so the narrow terminal edge engages the flange, and (b) with the jaws grasping the flange and the narrow terminal edge engaging the flange, advancing the tool with a forcing screw to remove the pulley from the crankshaft.

DESCRIPTION OF THE DRAWING

One embodiment of this invention, illustrating all its features, will now be discussed in detail. This embodiment depicts the novel and non-obvious pulley removal system, kits, and jaw component of this invention as shown in the accompanying drawing, which is for illustrative purposes only. This drawing includes the following figures (Figs.), with like numerals indicating like parts.

DETAILED DESCRIPTION OF ONE EMBODIMENT OF THE INVENTION

FIG. 1—Prior Art

Figures 1, 3, 4, 4A, 5:
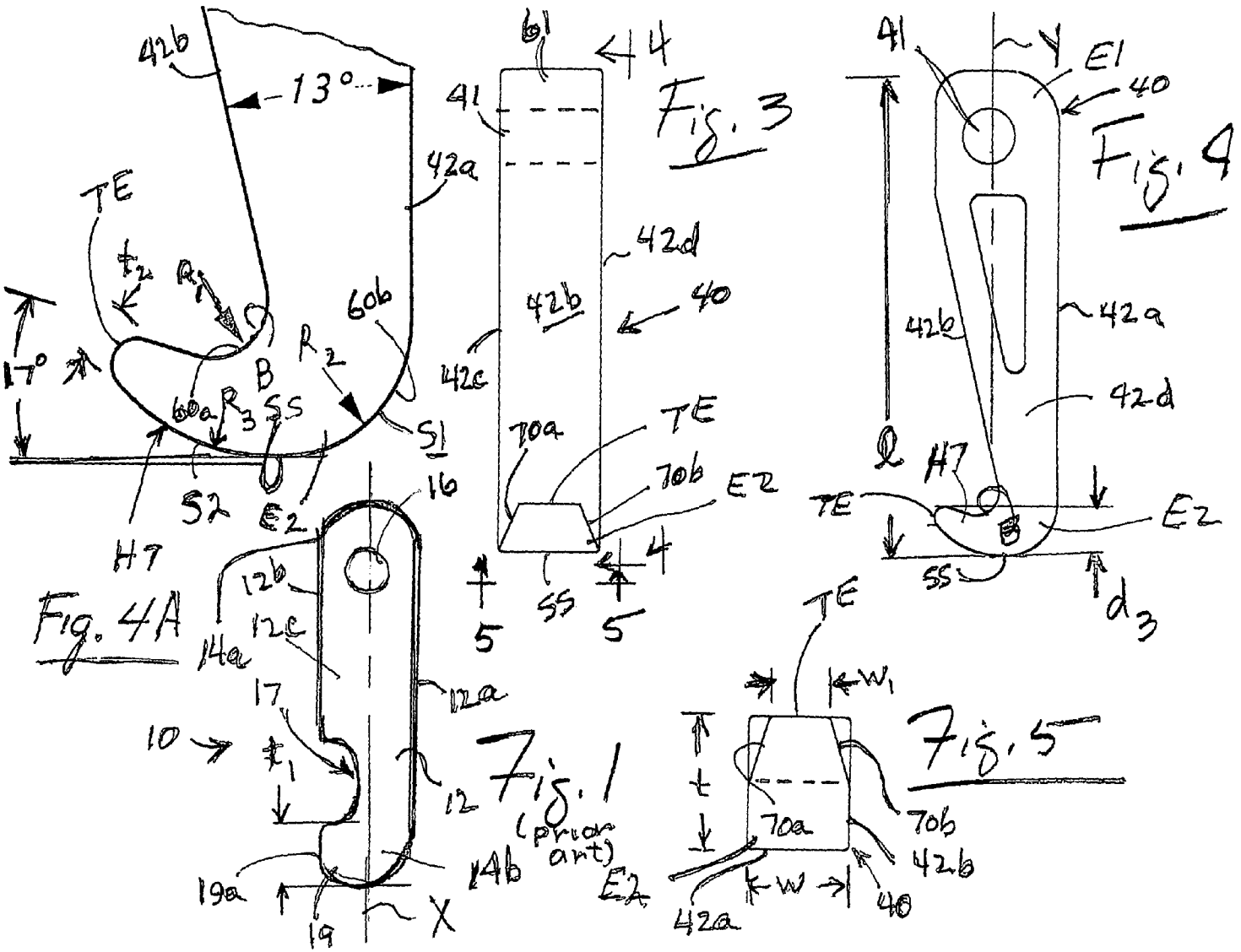
Fig. 1 (prior art)
FIG. 1 is a side view of a jaw member of a prior art pulley puller tool.
FIG. 3 is a plan view of the underside of one of the jaw members of the pulley removal system illustrated in FIG. 2
FIG. 4 is a side view taken along line 4-4 of FIG. 3.
FIG. 4A is an enlarged, fragmentary view of the tip of the jaw member of FIG. 3.
FIG. 5 is a front end view taken along line 5-5 of FIG. 3.
Figure 1A:
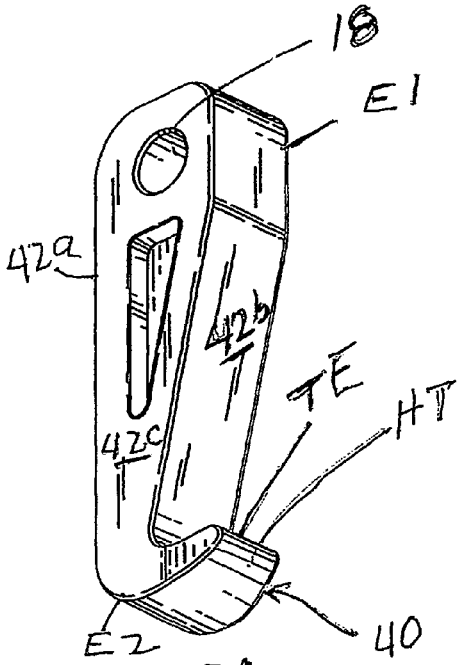
FIG. 1A is a perspective view of a jaw member in accordance with this invention.

One problem with conventional pulley removal systems is that the jaw members used only fit into the restricted space surrounding a pulley mounted on the end of a crankshaft of the older Chrysler and GM engine models. As shown in FIG. 1, the prior art jaw member 10 comprises a metallic, elongated body 12 having a substantially flat top surface 12*a*, a substantially flat underside surface 12*b*, and opposed substantially flat side surfaces, only side 12*c* shown, substantially at a right angle to the top and underside surfaces. Near a hub connection end 14*a* is an opening 16, which is substantially at a right angle to a reference line X, for receiving a detent pin 18 (FIG. 2) to connect the jaw member to a hub member 20 of the prior art pulley removal system. Near a flange grasping end 14*b* is a semicircular cut-a-way portion 17 that forms a blunt tip 19 with a flat, fat lip 19*a* having a thickness $t_1$ that is greater than 0.400 inch. This blunt tip 19 is able to fit within a restricted space between the engine block and a flange of the pulley mounted to the crankshafts of many older models of the Chrysler and GM engines but not the more recent engine models.

Figure 7:
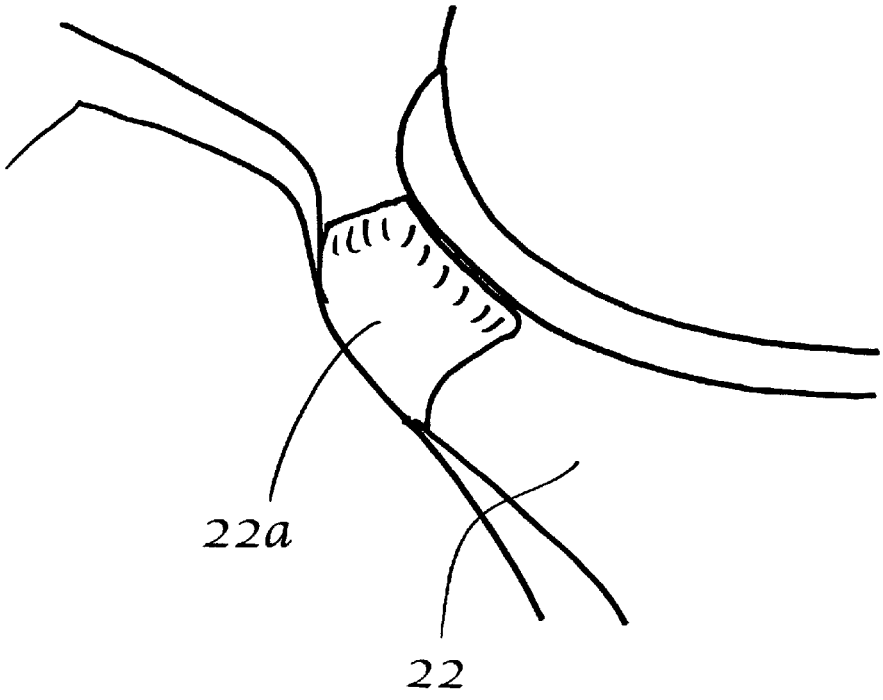
FIG. 7 is a perspective view of an underside of a flange of the pulley being removed in FIG. 6.
Figure 9:
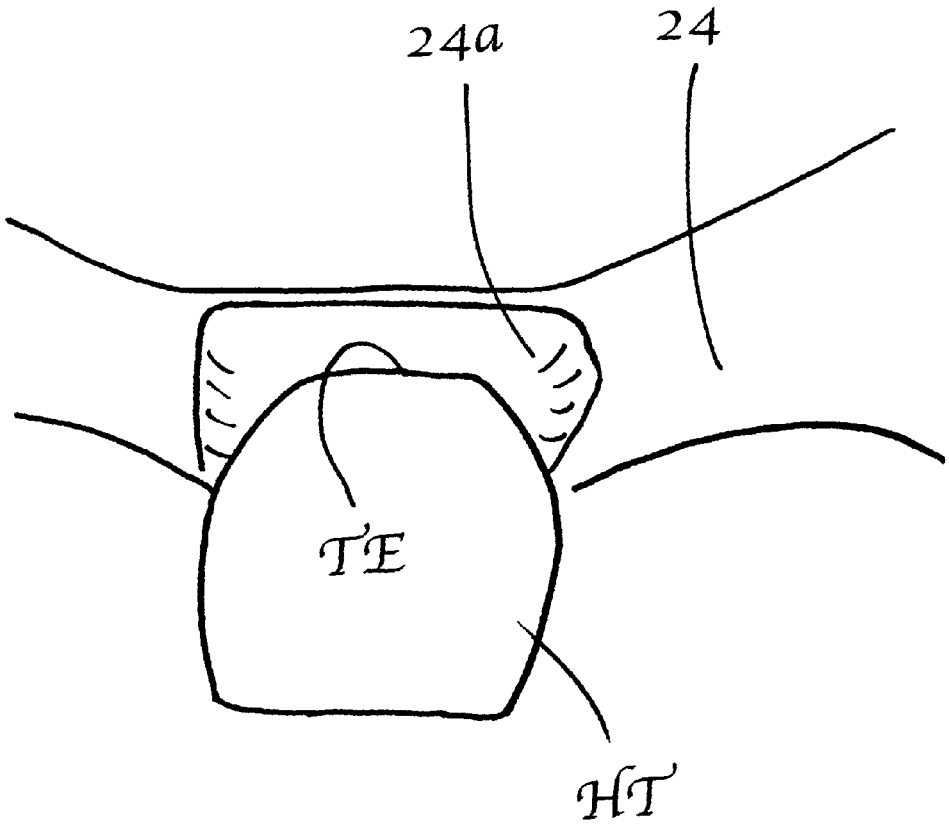
FIG. 9 is a plan view of the hooked tip of a jaw member of the pulley removal system of this invention positioned in a recess in the underside of a flange that has a different configuration and dimensions than the recess shown in FIG. 7.

Another problem with the prior art jaw members 10 is they do not properly engage a recess in the flanges 22 (FIG. 7) of the pulleys used with the more recent engine models. As shown in FIG. 7, the flanges 22 of pulleys used with the recent engine models have recesses 22*a* therein on their undersides that taper inward. As shown in FIG. 9, the flanges 24 of pulleys used with the older engine models have recesses 24*a* therein on their undersides that do not taper inward and are slightly wider. As discussed subsequently in greater detail, this imposes an additional consideration in designing a jaw member that will work with both the older engine and more recent engine models.

A third problem is that the prior art pulley removal system fails to provide longer push rods needed to interact with the crankshafts of the more recent engine models.

FIGS. 1A through 6

Figure 6:
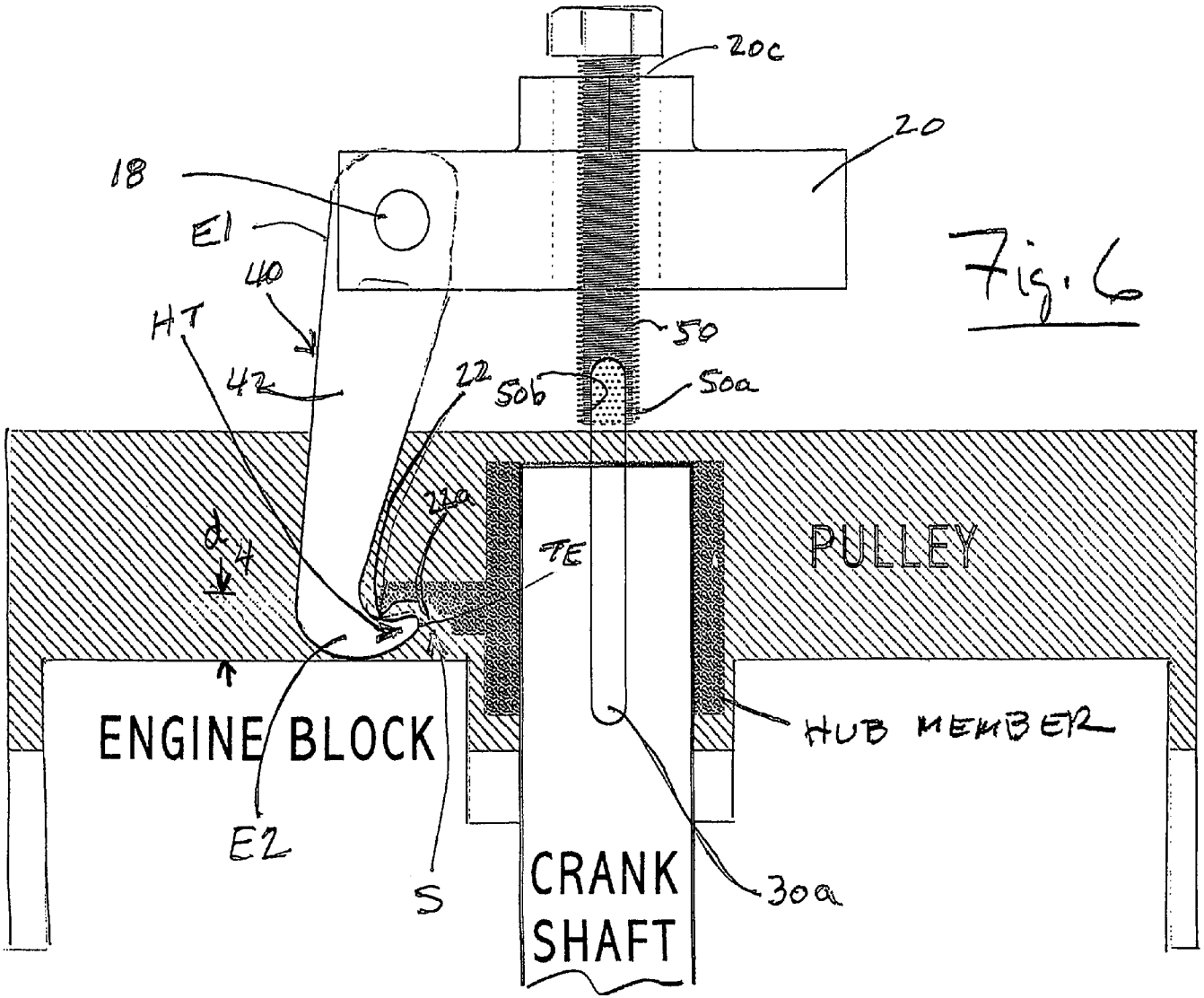
FIG. 6 is a schematic cross-sectional view showing the pulley removal system of this invention assembled and gripping a pulley for removal.

The pulley removal system 100 (FIG. 2) of this invention differs from the prior art in several ways: One, it includes at least one additional push rod 30 that is longer than push rods 30*a*, 30*b* 30*c* previously used. And two, it uses a puller jaw members 40 shown best in FIGS. 1A, and 3 through 5 that is configured differently than the prior art jaw members as shown in FIG. 1. As depicted in FIG. 6, the jaw members (only one shown) of this invention are configured to fit within the restricted space S between the engine block and the flange of the hub of a pulley attached to an end of a crankshaft extending through an engine block.

Figure 2A:
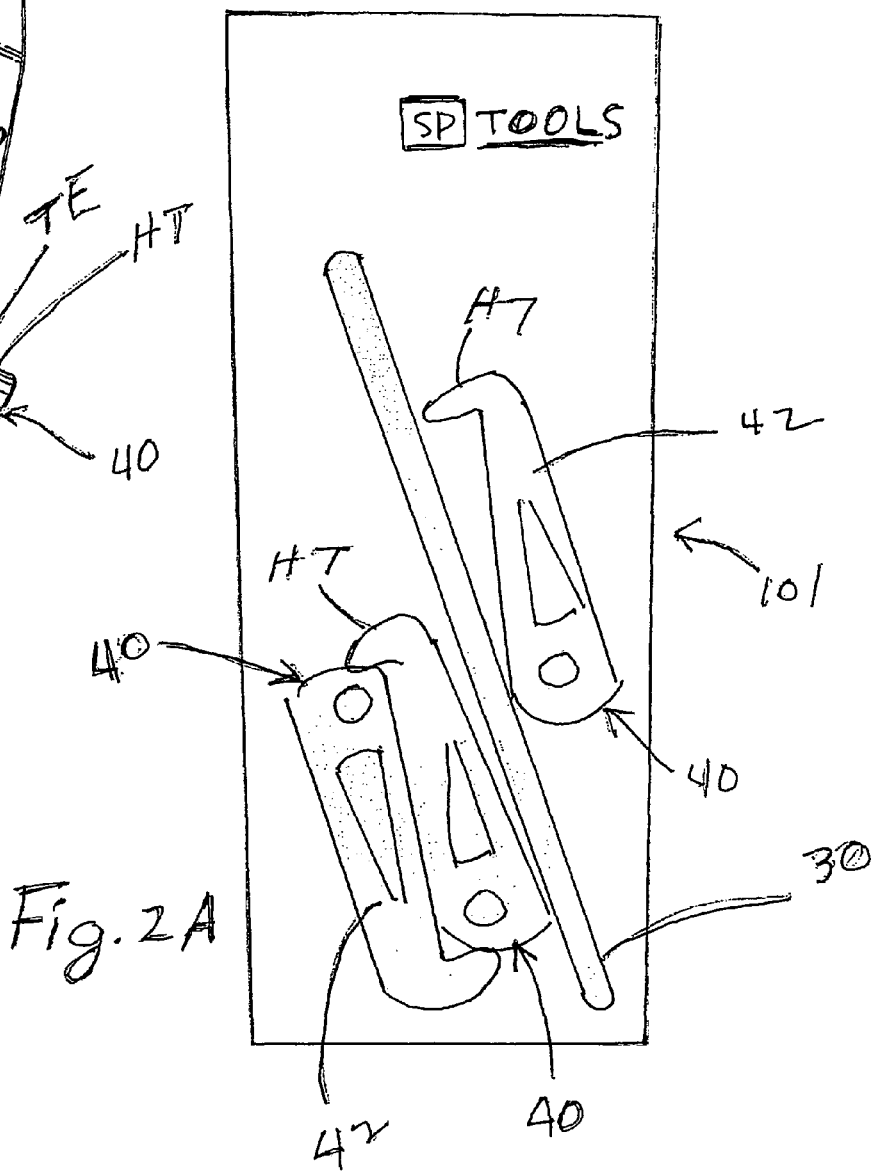
FIG. 2A is a perspective view of a kit including replacement jaw members and an additional push rod for use with a prior art pulley puller tool.
Figure 2:
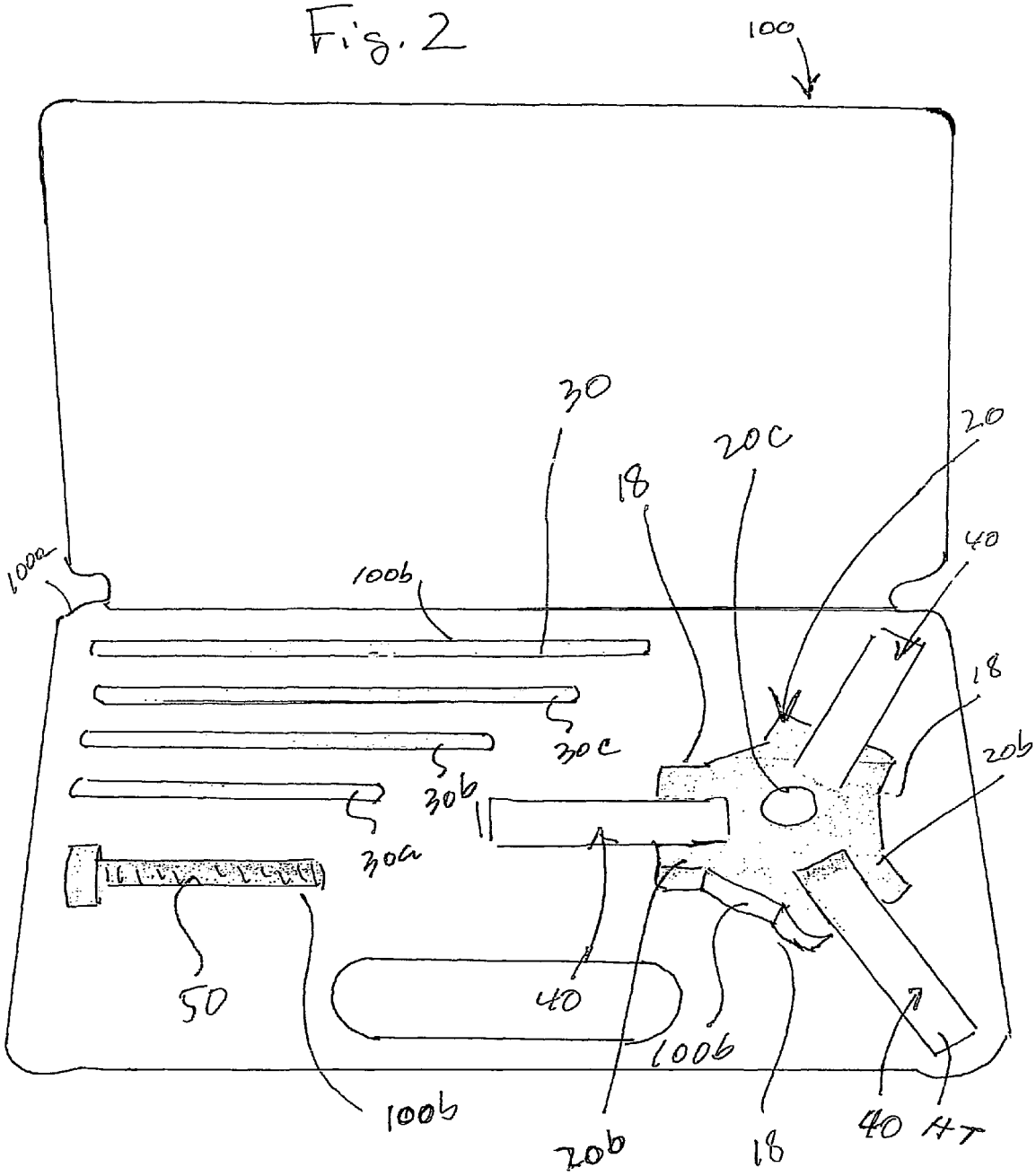
FIG. 2 is a perspective view of a kit including one embodiment of the pulley removal system of this invention.

One embodiment of the pulley removal system of this invention, as best illustrated in FIGS. 2 and 6, includes (1) a hub member 20, (2) a plurality of puller jaw members 40 adapted to be detachably and radially connected to the hub member, (3) a plurality of push rods 30, 30*a*, 30*b*, and 30*c*, each rod having a length differing from the other rods and each rod adapted to interact with a crankshaft end (FIG. 6) of the engine on which the pulley is mounted when the pulley is being removed, and (4) a screw member 50 that is adapted to be threaded into a threaded center opening 20*c* in the hub member. The screw member 50 has a tip 50.*a* with a cavity 50*b* therein extending lengthwise that is adapted to receive a portion of an individual push rod during removal of the pulley.

The pulley removal system 100 of this invention may be retained for shipment and storage in a kit having a tray 100*a* with indentations 100*b* therein that receive the individual push rods 30, 30*a*, 30*b*, and 30*c*, screw member 50, and hub member 20, with the jaw members 40 detachably connected to yoke elements 20*b* of the hub member by detent pins 18 passing though an opening 41 in the individual jaw members. The yoke elements 20*b* are spaced apart 120 degrees. FIG. 2A illustrates another kit 101 comprising a blister pack including only three jaw members 40 configured in accordance with this invention and one long push rod 30. This kit 101 thus has the necessary components to replace the prior art jaw members 10 used in prior art pulley removal systems and provide the additional longer rod needed for the recent engine models.

Referring to FIGS. 1A, 3 through 5, each jaw member 40 of the system of this invention is essentially identical and comprises a metallic, elongated body 42 having a longitudinal reference line Y, a substantially flat top surface 42*a*, a substantially flat and inclined underside surface 42*b*, and opposed substantially flat sides 42*c* and 42*d* substantially at a right angle to the top and underside surfaces. The elongated body 42 has a predetermined length l substantially from 2.250 to 3.250 inches, a predetermined width w substantially from 0.250 to 0.750 inches that is substantially constant along the length l of the body, and a predetermined thickness t substantially from 0.600 to 1.000 inches that is greater near its hub connection end E1 than near its flange gripping end E2. The width w of the body 42 is substantially constant along its length l. Like the prior art jaw member 10, the hub connection end E1 is adapted to be attached to the hub member 20 using a detent pin 18 passing through the yoke element 20*b* of the hub member 20 and the opening 41 in its hub connection end E1. The flange gripping end E2 differs significantly from the prior art jaw member (FIG. 1) and has a hooked shaped tip HT with dimensions that enable it to access the restricted space S surrounding the pulley mounted to the crankshafts of both the older and more recent engine models and has a narrow terminal edge TE that enables it to be received in the recesses 22*a* or 24*a*, as the case may be, in the flanges of different pulleys for both the older and more recent engine models. The distance $d_4$ (FIG. 6) between the exterior surface of the engine block and the flange is no greater than 0.315 inch in most cases and, as illustrated in FIG. 6, the hooked tip HT is configured to fit in this restricted space S.

As depicted in FIG. 4A, the hooked tip HT has an inner, concave arcuate surface 60*a* and an outer, convex arcuate surface 60*b* that are opposed but curve in the same general direction to diverge outwardly from the narrow terminal edge TE. The inner arcuate surface has a radius of curvature $R_1$ substantially from 0.075 to 0.250 inch and the outer arcuate surface is a compound curve comprising sections S1 and S2 that converge to form a sole section SS. The section S1 has a radius of curvature $R_2$ substantially from 0.250 to 0.400 inch and the section S2 with a radius of curvature $R_3$ substantially from 0.350 to 0.750. The radius of curvature $R_2$ of the section S1 of the outer arcuate surface 60*b* is greater than the radius of curvature $R_1$ of the inner arcuate surface 60*a*. The section S1 of the outer arcuate surface 60*b* merges with the top surface 42*a* near the end E2 and the inner arcuate surface 60*a* merges with the underside surface 42*b* near this end E2. The thickness t of the body 40 gradually decreases linearly and uniformly from near the hub connection end E1 to near the flange gripping end E2 so the flat underside surface 42*b* inclines towards the hooked tip HT to form a bite B where the underside surface merges with the inner arcuate surface 60*a* to configure the hooked tip to enable it to fit within the restricted space S as shown in FIG. 6. At least a portion of the bite B is offset inwardly of the narrow terminal edge TE. The terminal edge TE is substantially straight and substantially at a right angle to the reference line. The top surface 42*a* and underside surface 42*b* form an angle substantially from 10 to 16 degrees, for example, 13 degrees.

Figure 8A:
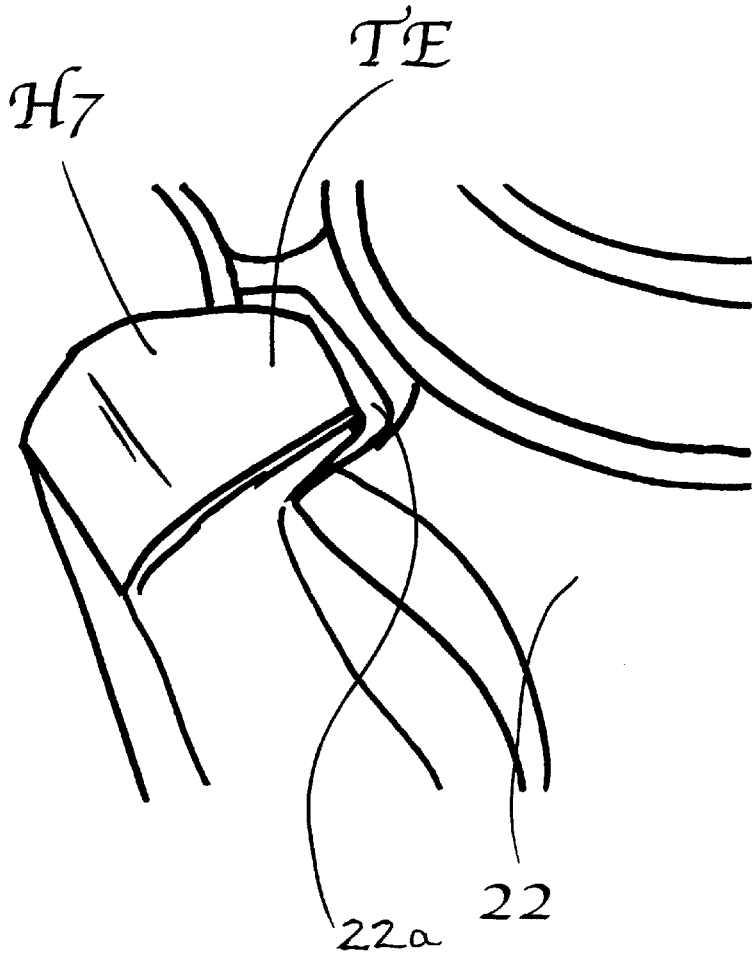
FIG. 8A is a perspective view of the hooked tip of a jaw member of the pulley removal system of this invention positioned in a recess in the flange shown in FIG. 7.
Figure 8B:
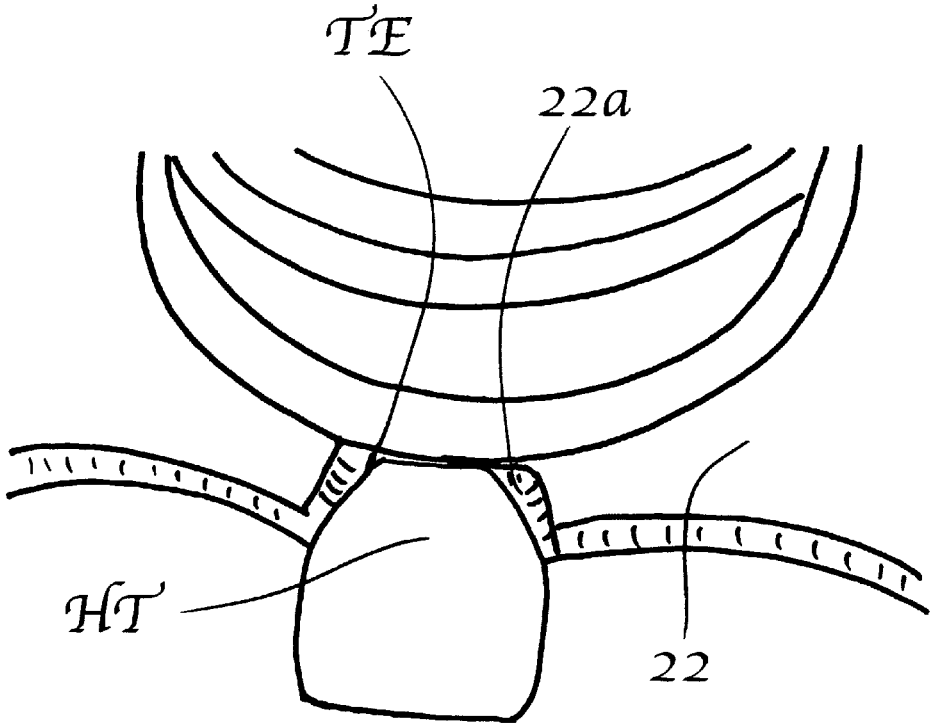
FIG. 8B is a plan view of the hooked tip of the jaw member shown in FIG. 8A positioned in the recess in the flange shown in FIG. 7.

As depicted in FIG. 5, the hooked tip HT has opposed sides 70*a* and 70*b* that taper inwardly towards the terminal edge TE, and its front surface area has a substantial trapezoidal shape encompassed by the narrow edge, tapered sides, and margin in dotted line where the sides begin to taper inwardly. As illustrated in FIGS. 8 and 8A, the hooked tip HT will be received within a small recess 22*a* in the flange of pulleys used with the recent engine models, and as illustrated in FIG. 9, the hooked tip HT will be received within a large recess 24*a* in the flange of pulleys used with the older engine models. Thus, the configuration and the predetermined dimensions of the hooked tip HT and its terminal edge TE enable it to fit within at least two recesses of different dimensions in the flanges of different types of pulleys. This terminal edge TE is rounded and has a maximum thickness $t_1$ of 0.250 inch, and has a maximum width $w_1$ dimension (FIG. 5) of 0.600 inch, and typically its width ranges substantially from 0.250 to 0.600 inch. In contrast, the blunt lip 19*a* of the prior art jaw member 10 has a thickness $t_1$ (FIG. 1) that is substantially greater than 0.400 inch. The sole section SS of the outer, convex arcuate surface 60*b* provides a land that is placed next to the substantially flat, exterior surface of the engine block adjacent a flange of a pulley being removed as depicted in FIG. 6.

To use the pulley removal system 100, the jaw members 40 are connected to the hub member 20 and the hooked tips HT of each jaw member are positioned in the space S surrounding the pulley being removed as illustrated in FIG. 6. The sole section SS does not touch, but clears the exterior surface of the engine block by about 0.020-0.050 inch, and the terminal edge TE just clears the underside of the flange because the distance $d_3$ between the outer portion of the terminal edge and the sole section SS is substantially equal to or less than the distance $d_4$. The angle between the exterior of the engine block and the inner arcuate surface 60*a* is substantially from 10 to 22 degrees, for example, 17 degrees.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

The invention claimed is:

1. A pulley removal system used to remove a pulley attached to an end of a crankshaft extending through an engine block, said pulley including a flange nearby said block to provide a restricted space between the engine block and the flange that is accessed during removal of the pulley, said system comprising a hub member, a plurality of puller jaw members adapted to be detachably and radially connected to the hub member, each said jaw member being essentially identical and each jaw member comprising an elongated body having a longitudinal reference line, a substantially flat top surface, and a substantially flat underside surface, said elongated body having first and second opposed ends, said first end being adapted to be attached to the hub member and said second end being free to grasp a flange of a pulley mounted to a crankshaft and including a hooked tip having inner and outer opposed arcuate surfaces that diverge outwardly from a narrow terminal edge, said outer arcuate surface merging with the top surface near said second end and said inner arcuate surface merging with the underside surface near said second end, said body having a thickness that gradually decreases linearly and uniformly from near the first end to near the second end so the flat underside surface inclines towards the hooked tip to form a bite where said underside surface merges with said inner arcuate surface to configure said hooked tip to enable said hooked tip to fit within said restricted space including a plurality of push rods, each rod having a length differing from the other rods and each rod adapted to interact with a crankshaft end of the engine on which the pulley is mounted when the pulley is being removed.

* * * * *